US005379006A

United States Patent [19]

McCorkle

[11] Patent Number: 5,379,006

[45] Date of Patent: Jan. 3, 1995

[54] WIDEBAND (DC TO GHZ) BALUN

[75] Inventor: John W. McCorkle, Laurel, Md.

[73] Assignee: The United States of America as represented by the Secretary of the Army, Washington, D.C.

[21] Appl. No.: 75,368

[22] Filed: Jun. 11, 1993

[51] Int. Cl.[6] ..... H01P 5/10

[52] U.S. Cl. ..... 333/26; 333/127

[58] Field of Search ..... 333/125, 127, 25, 26; 343/859

[56] References Cited

U.S. PATENT DOCUMENTS

| | | | |
|---|---|---|---|
| 3,357,023 | 12/1967 | Hemmie | 333/25 X |
| 3,656,071 | 4/1972 | Woodward | 333/26 |
| 3,784,933 | 1/1974 | Scherer et al. | 333/26 |
| 4,916,415 | 4/1990 | Moulton et al. | 333/26 |
| 5,115,214 | 5/1992 | Gassmann et al. | 333/26 |
| 5,148,130 | 9/1992 | Dietrich | 333/25 |

OTHER PUBLICATIONS

IDA Document D-1250; Proceedings of the BTI/-DARPA Ultra-Wideband Radar Technology Workshop Sep. 22-23, 1992 pp. 345-348.

*Primary Examiner*—Paul Gensler

*Attorney, Agent, or Firm*—Freda L. Krosnick; Frank J. Dynda

[57] ABSTRACT

An ultra wide band DC to GHz balun consisting of transmission lines, a small inverting junction, and an RC network connecting the shields of the balanced load transmission lines such that an unbalanced source sees a matched load from DC to GHz.

8 Claims, 6 Drawing Sheets

BALUN TRANSFER FUNCTION (BACK-TO-BACK)

WIDEBAND (DC TO GHZ) BALUN

RIGHTS OF THE GOVERNMENT

The invention described herein may be manufactured, used and licensed by or for the United States Government for Governmental purposes without payment to us of any royalty thereon.

BACKGROUND OF THE INVENTION

1. Field of the Invention

The present invention relates to a wideband (DC-to-GHz) balun. This wideband balun is suitable for use in communication systems, radars, radio frequency transmitters, receivers, signal processors, and more specifically to ultra wide band (UWB) applications such as impulse radar.

2. Description of the Prior Art

A great variety of baluns are available commercially that cover a broad spectrum in terms of size, bandwidth, center frequency, and insertion loss. However, these commercial baluns do not have the wide bandwidth, balance, or insertion loss required for ultra wide bandwidth applications such as impulse radar. Impulse radar is presently being used in a variety of radar systems to detect aircraft, ground vehicles, people, mines, buried pipes, roadway faults, buried homocide victims, tunnels, leaking buried pipes and similar items. Consequently, it is desirable to have a balun theft maintains low insertion loss and good balance for UWB applications.

Accordingly, it is an object of this invention to provide a balun that maintains low insertion loss and good balance for ultra wide band (UWB) applications.

SUMMARY OF THE INVENTION

Briefly, the foregoing and other objects are achieved by connecting two transmission lines of a certain impedance (2Z) to a transmission line with half the impedance (Z) of each of the two transmission lines at a junction where all the lines are in parallel but one of the 2Z transmission lines is inverted with respect to the other 2Z line, and the common leads of the 2Z lines are connected through a parallel resistor/capacitor (RC) network at their output side. The transmission lines can be loaded with ferrite material to improve the low frequency response.

BRIEF DESCRIPTION OF THE DRAWINGS

A better understanding of the invention will be obtained when the following detailed description of the invention is considered in connection with the accompanying drawings in which.

DETAILED DESCRIPTIONS OF SPECIFIC EMBODIMENTS

Figure 1:
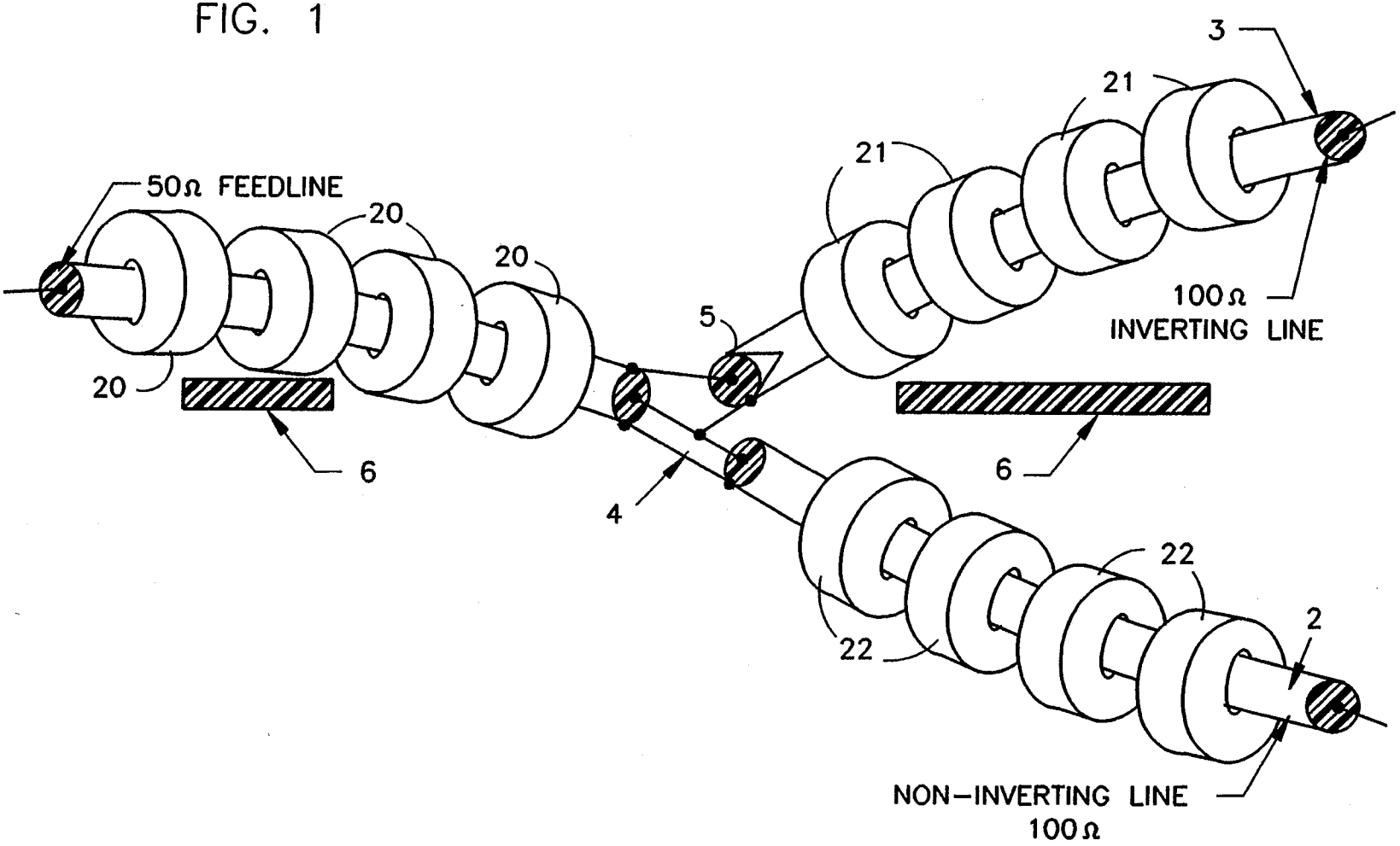
FIG. 1 shows a close-up of the junction of the balun A.
Figure 2:
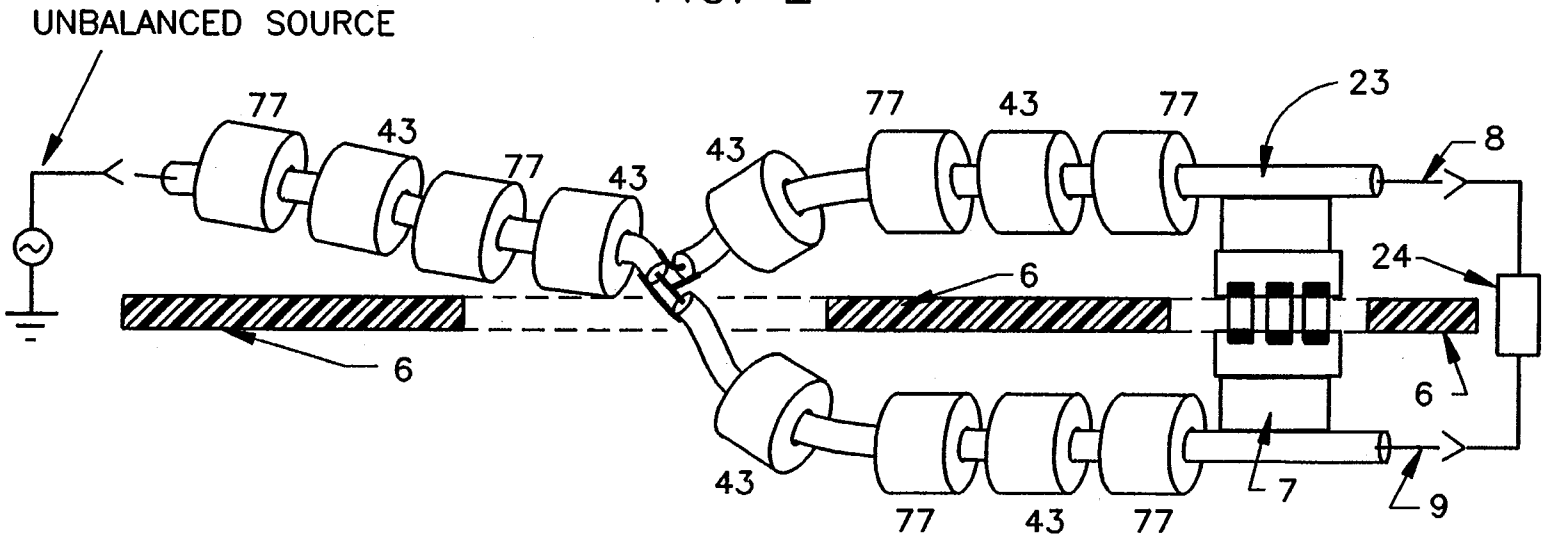
FIG. 2 shows a side view of the entire balun A.

The following description is of two specific embodiments of this invention. Referring to FIGS. 1 and 2, embodiment A of the DC-to-GHz balun consists of a 50 ohm unbalanced coaxial input transmission line 1, a first 100 ohm output coaxial transmission line 3, and a second 100 ohm output coaxial transmission line 2 connected at a first junction 4. The output lines 3 and 2 are equal in length. The junction 4 is formed by connecting the three transmission lines 1, 2, and 3 in parallel such that the first output coaxial transmission line 3 is inverted with respect to the other output coaxial transmission line 2; that is the center conductor of line 3 is connected to the outer conductor of line 1 and line 2, and the other conductor of line 3 is connected to the center conductors of line 2 and line 1. It should be noted that although the drawings show coaxial transmission lines, twin-lead or twisted pair or other transmission lines are equally usable. It is important that the junction 4 be as small as mechanically possible and it is also important that the ferrite cores 20, 21, and 22 be as close as possible to the junction 4. Ferrite cores need not be used, but the low frequency response will suffer; however, the configuration A will still be an ultra wide band balun with good balance. In the case of coaxial lines, a small wedge 5, can be cutout of the shields or outer conductors at the junction to allow the junction 4 to be very small without shorting the inverting line 3 to the shields or outer conductors of the other two lines 1 and 2.

Figure 3:
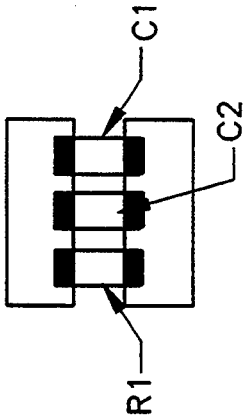
FIG. 3 shows a close-up of the small printed circuit board for the resistor/capacitor network.

Referring to FIG. 2 and FIG. 3, a convenient structural support for the balun consists of a printed circuit board 6 with two holes cut into it; one hole for a first junction 4, and a second hole to allow space for a small printed circuit board 7 (as shown in FIG. 3) which holds a parallel resistor-capacitor network which connects the outer conductors or shields of lines 3 and 2 at a second junction 23. At DC (Direct Current), R1 is in parallel with the balanced load 24, R1 can be chosen to be 4Z/3, where Z is the impedance of the input unbalanced transmission line 1 which is coaxial in this preferred embodiment, so that an unbalanced source sees a matched load at DC. C1 is a high-Q low ESR (equivalent series resistance) microwave capacitor to effectively be a short circuit at microwave frequencies. C2 is usually a higher value capacitor that is chosen to match the effective inductance of the loaded transmission lines 2 and 3, such that an unbalanced source at the input 25 of transmission line 1 sees a matched load from DC up through the highest frequencies used. Alternatively, the RC network 7 can be replaced with a short circuit if matching at DC is not necessary. The balanced load 24 is connected to the remaining leads 8 and 9 which are the center conductors of the transmission lines 3 and 2 in the case of using coaxial transmission lines.

Figure 4:
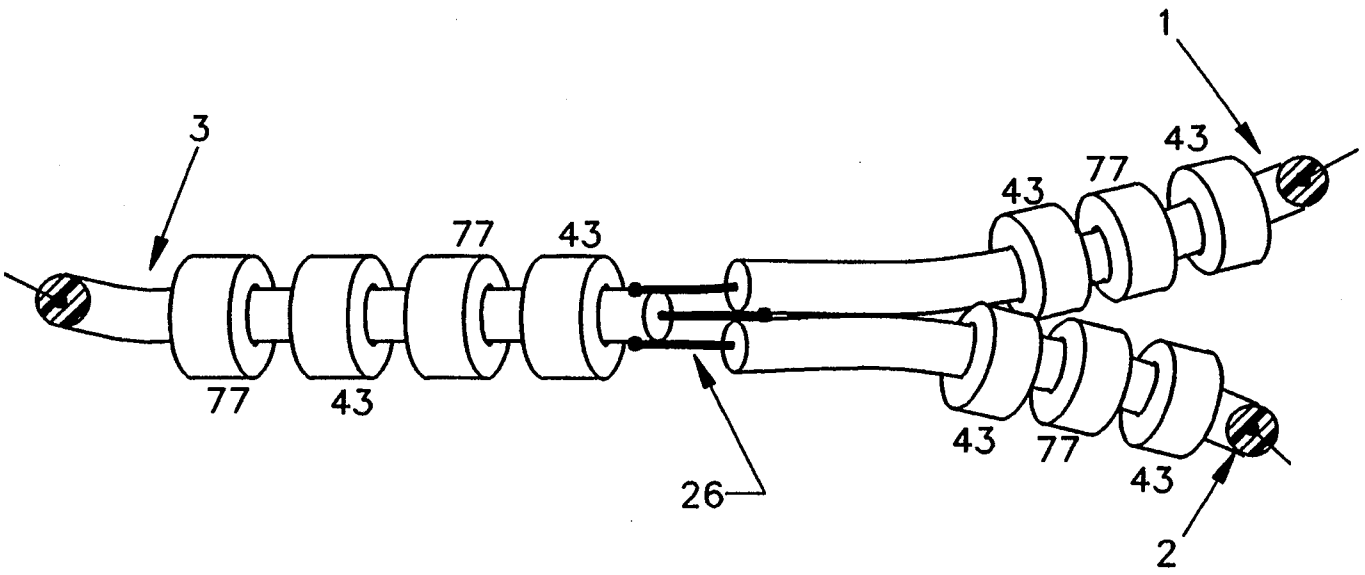
FIG. 4 shows a close-up of the junction of the balun B.
Figure 5:
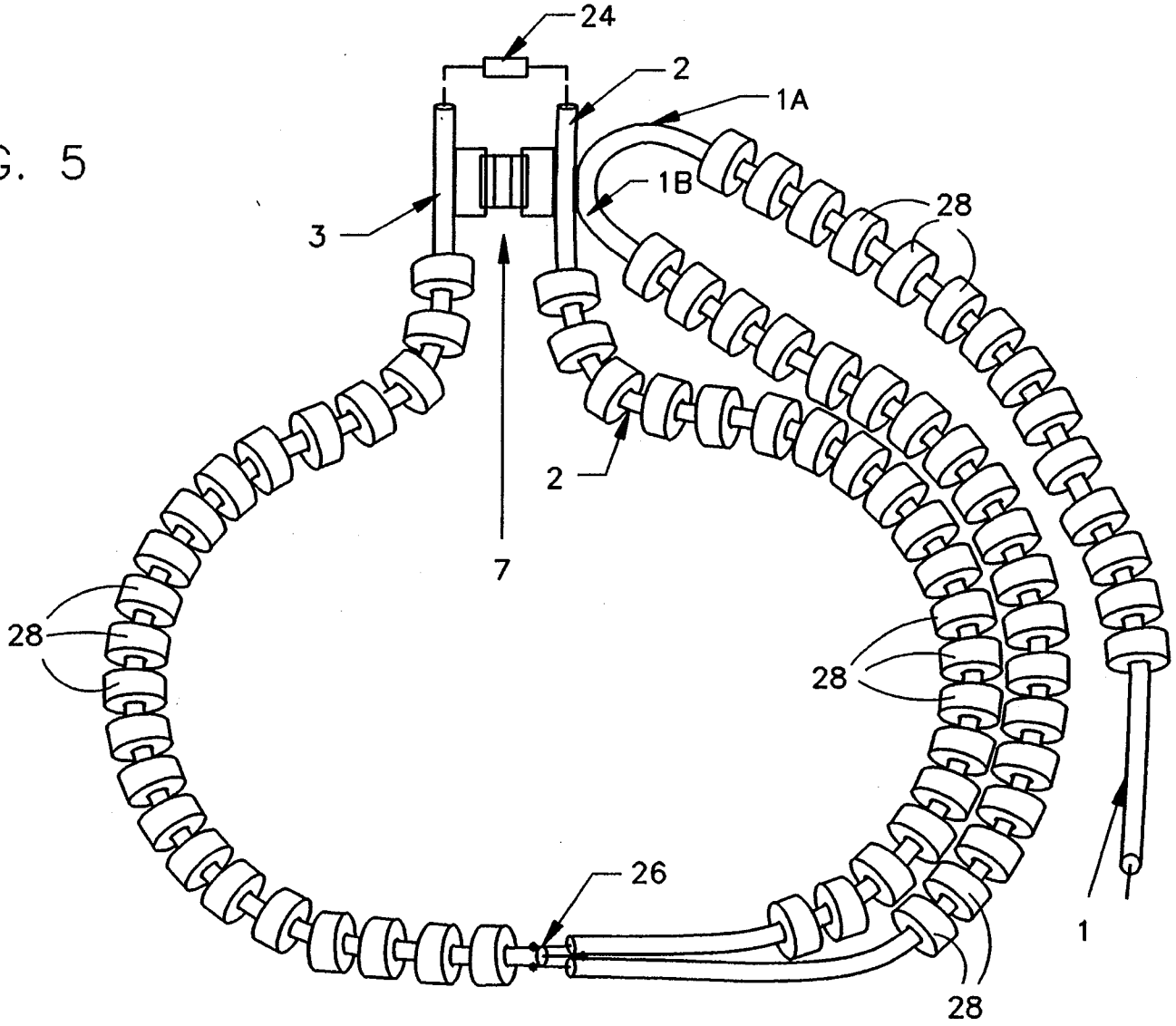
FIG. 5 shows a side view of the entire balun B.

An alternate construction, embodiment B of the wide band balun is shown in FIG. 5 with the small compact junction 26 shown in FIG. 4. This construction splits the unbalanced input line 1 into two parts 1A and 1B. The outer conductor or shield of transmission line 1 at point 27 is connected to the shields of the two output transmission lines 2 and 3 at the junction 23 where the printed circuit board 7 also connects the shields of the output transmission lines 2 and 3. This construction decouples the function of common mode isolation with that of forming the balanced signals. The ferrite cores 28 on 1A create inductance to perform the function of common-mode isolation. The cores 28 on 1B, 2, and 3 create inductance to isolate the inverting junction 26 and form the balanced signals. With this construction, the shields of 1B and 2 could be bonded up to the RC network board 7 and the cores 28 on 1B and 2 could be combined so that each core 28 encompassed both 1B and 2. The critical goal is to keep the inverting junction 26 as small as possible. This goal is achieved by bringing the inverting 3 and non-inverting 2 and 1B leads in a nose to nose fashion, as shown in FIG. 4, which allows the connecting leads to be very short and allows the cores 28 to be brought in close or even on top of the junction 26.

Figure 6:
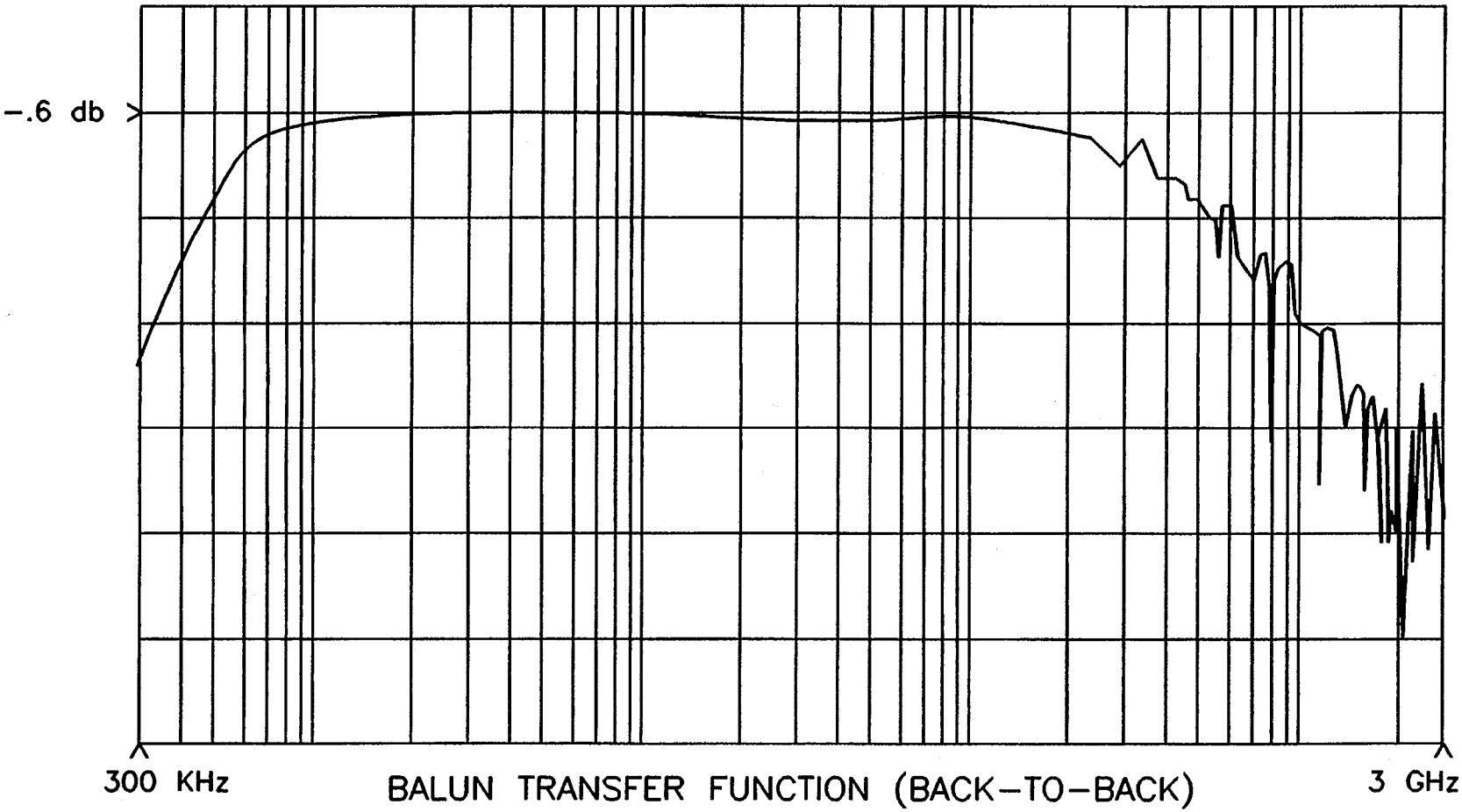
FIG. 6 shows the back-to-back transfer function of balun B with R=0.
Figure 7:
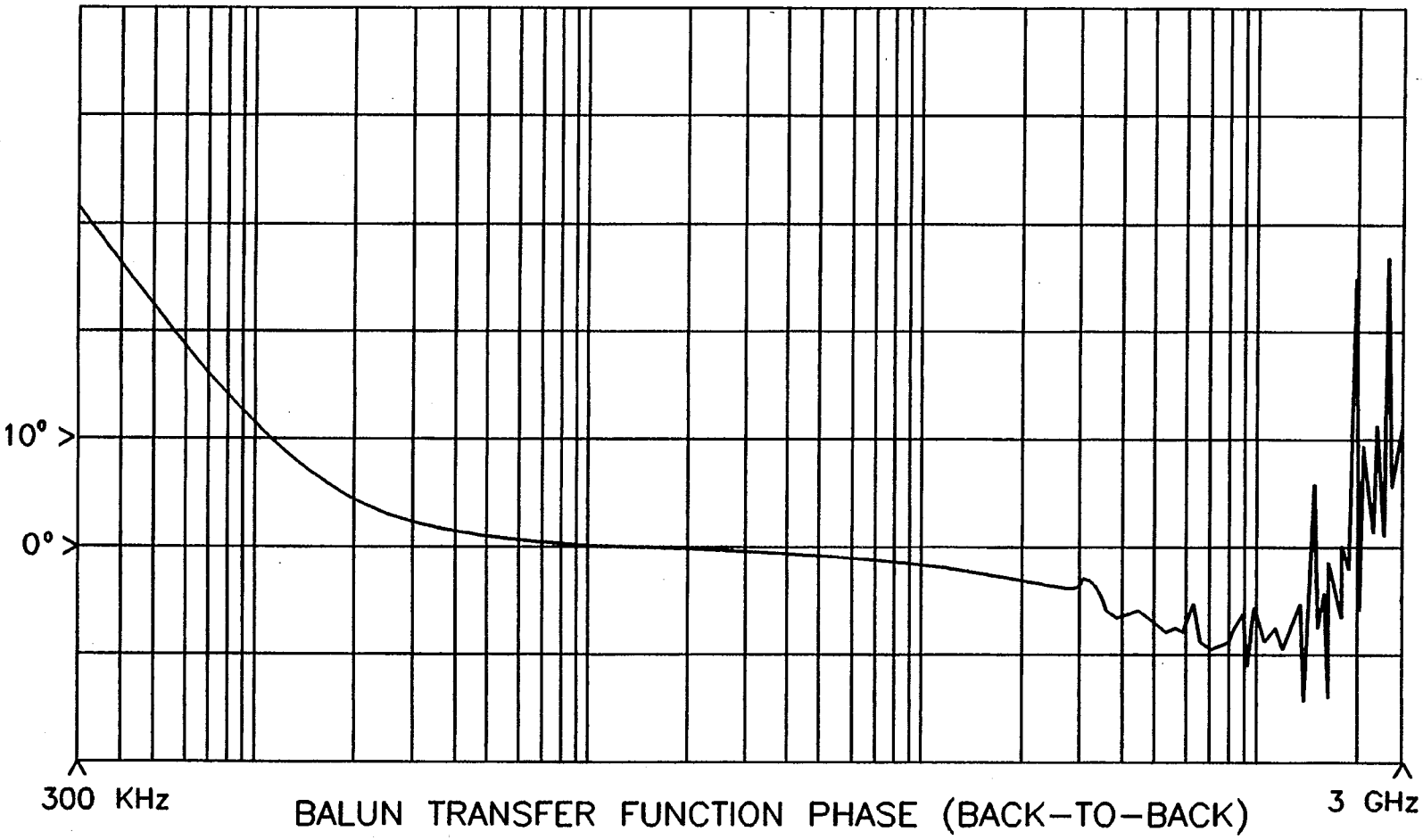
FIG. 7 shows the back-to-back phase transfer function of balun B with R=0.

The ferrite cores 28 used were manufactured from type material 43 and 77 obtained from AMIDON Associates of Torrance Calif. 90508. The balun shown in FIG. 2 and FIG. 1 used part numbers FB-43-5621 and FB-77-5621 ferrite cores. It was important that the FB-43 series ferrite cores were used nearest the junction shown in FIG. 1. Ferrite cores 77 and 43 were placed around the transmission lines as shown in FIG. 2. For the construction shown in FIG. 4 and 5, the ferrite cores 28 used were the FB-77-6301 and FB-43-6301 series cores. In FIG. 4 the cores 28 were alternately the 77 and 43 type cores of the 6301 series, and again, 43 type material was used nearest the junction 26. The 77 material is useful at lower frequencies, and the 43 material is useful at the higher frequencies. Ferrite core loading need not be used in construction type B, but again the lower frequency response suffers; however, this B type construction also works effectively as an ultra wide band balun with good balance. FIG. 6 shows the balun transfer function for a back-to-back configuration of baluns of the construction shown in FIG. 5 with R1=0 in the RC network of the printed circuit board 7. FIG. 7 shows the balun phase transfer function for the same construction shown in FIG. 5. Curves similar to FIGS. 6 and 7 for configurations without ferrite core loading would drop off at a higher frequency. The curves in FIGS. 6 and 7 are representative of ferrite loaded transmission lines in accordance with the invention disclosed herein. Standard measurement techniques in the art were used.

Numerous modifications and variations of the present invention are possible in light of the above teachings to those experienced and skilled in the art. For example, the RC network 7 could be changed to effect a different matching characteristic if desired, or the cable routing of the transmission lines might be different yet consistent with the electrical connections shown. The unbalanced feed line 1 in FIG. 5 could be brought out on the left side instead of the right by simply letting it cross over the balance output leads 2 and 3 instead of looping back and coming out on the right. It is therefore to be understood that within the scope of the following claims, the invention may be practiced otherwise than as specifically described herein. This invention should not be restricted to its disclosed embodiment but rather should be viewed by the intent and scope of the following claims.

What is claimed is:

1. An ultra wide band balun comprising:

an unbalanced coaxial input transmission line, said input transmission line being encircled with at least one ferrite core;

a first output coaxial transmission line encircled with at least one ferrite core connected to said unbalanced input transmission line at a first junction wherein the center conductor of said first output transmission line is connected to the outer conductor of said unbalanced coaxial input transmission line, and wherein the outer conductor of said first output coaxial transmission line is connected to the inner conductor of said unbalanced coaxial input transmission line;

a second output coaxial transmission line encircled with at least one ferrite core connected to said unbalanced input transmission line at said first junction wherein the center conductor of said second output coaxial transmission line is connected to the center conductor of said unbalanced input transmission line, and wherein the outer conductor of said second output coaxial transmission line is connected to the outer conductor of said unbalanced input transmission line; and a resistor-capacitor circuit connecting the outer conductors of said first and said second output coaxial transmission lines at a second junction wherein the center conductors of said first and said second output coaxial transmission lines are connected to a balanced load.

2. An ultra wide band balun as in claim 1 wherein the outer conductor of said unbalanced coaxial input transmission line is connected to the outer conductors of said first and second output coaxial transmission lines at said second junction and wherein at least one ferrite core encircles said unbalanced coaxial input transmission line at a point between said first junction and said second junction, and wherein at least one ferrite core encircles said unbalanced coaxial input transmission line between said second junction and the input end of said unbalanced coaxial input transmission line.

3. An ultra wide band balun as in claim 2 wherein said first junction comprises said unbalanced coaxial input transmission line and said second output coaxial transmission line placed in a parallel fashion so that the center conductors of these lines are head-on to the outer conductor of said first output coaxial transmission line and wherein the center conductor of said first output coaxial transmission line is connected head-on to the outer conductors of said transmission lines placed in a parallel fashion wherein a small junction is produced.

4. An ultra wide band balun as in claim 1 comprising a printed circuit board supporting said unbalanced coaxial input transmission line, said first and second output coaxial transmission line, said first junction, said second junction, and said resistor-capacitor circuit.

5. An ultra wide band balun comprising:

an unbalanced coaxial input transmission line; a first output coaxial transmission line connected to said unbalanced input transmission line at a first junction wherein the center conductor of said first output transmission line is connected to the outer conductor of said unbalanced coaxial input transmission line, and wherein the outer conductor of said first output coaxial transmission line is connected to the inner conductor of said unbalanced coaxial input transmission line;

a second output coaxial transmission line connected to said unbalanced input transmission line at said first junction wherein the center conductor of said second output coaxial transmission line is connected to the center conductor of said unbalanced input transmission line, and wherein the outer conductor of said second output coaxial transmission line is connected to the outer conductor of said unbalanced input transmission line; and a resistor-capacitor circuit connecting the outer conductors of said first and said second output coaxial transmission lines at a second junction wherein the center conductors of said first and said second output coaxial transmission lines are connected to a balanced load.

6. An ultra wide band balun as in claim 5 wherein the outer conductor of said unbalanced coaxial input transmission line is connected to the outer conductors of said first and second output coaxial transmission lines at said second junction.

7. An ultra wide band balun as in claim 6 wherein said first junction comprises said unbalanced coaxial input transmission line and said second output coaxial transmission line placed in a parallel fashion so that the center conductors of these lines are head-on to the outer conductor of said first output coaxial transmission line and wherein the center conductor of said first output coaxial transmission line is connected head-on to the outer conductors of said transmission lines placed in a parallel fashion wherein a small junction is produced.

8. An ultra wide band balun as in claim 5 comprising a printed circuit board supporting said unbalanced coaxial input transmission line, said first and second output coaxial transmission line, said first junction, said second junction, and said resistor-capacitor circuit.

* * * * *